US006755697B2

(12) United States Patent
Kojima et al.

(10) Patent No.: US 6,755,697 B2
(45) Date of Patent: Jun. 29, 2004

(54) FEMALE TERMINAL FITTING WITH A RESILIENT CONTACT PIECE LOCKED AT A SPECIFIED POSITION THEREIN

(75) Inventors: Eiji Kojima, Yokkaichi (JP); Hirotaka Makino, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/294,787

(22) Filed: Nov. 14, 2002

(65) Prior Publication Data

US 2003/0096533 A1 May 22, 2003

(30) Foreign Application Priority Data

Nov. 22, 2001 (JP) ..... 2001-357038

(51) Int. Cl.[7] ..... H01R 11/22; H01R 13/11; H01R 13/40

(52) U.S. Cl. ..... 439/852; 439/595

(58) Field of Search ..... 437/595, 852, 437/843, 844

(56) References Cited

U.S. PATENT DOCUMENTS

| | | | | | |
|---|---|---|---|---|---|
| 5,775,962 | A | * | 7/1998 | Kakuta et al. | 439/852 |
| 5,827,086 | A | * | 10/1998 | Fukuda | 439/357 |
| 6,379,195 | B1 | * | 4/2002 | Torikoshi et al. | 439/733.1 |
| 2002/0077000 | A1 | * | 6/2002 | Nimura | 439/852 |
| 2003/0049975 | A1 | * | 3/2003 | Tsuji et al. | 439/843 |

FOREIGN PATENT DOCUMENTS

WO WO 98/29924 7/1998

* cited by examiner

*Primary Examiner*—Chandrika Prasad
(74) *Attorney, Agent, or Firm*—Anthony J. Casella; Gerald E. Hespos

(57) ABSTRACT

A female terminal fitting (1) has a rectangular tubular connecting portion (5) for connection with a male tab (4). First and second contacts (9C, 18) are provided respectively on first and second opposed walls (23, 17) of the connecting portion (5). The contacts (9C, 18) resiliently contact and hold the male tab (4). The first contact (9C) is provided at the leading end of a resilient contact piece (9). An engaging edge (25) projects from one side of a base (9A) of the resilient contact piece (9) and is fit into a locking hole (26) formed in a sidewall (15) to position the base (9A) of the resilient contact piece (9) and prevent it from being raised.

6 Claims, 6 Drawing Sheets

100

FEMALE TERMINAL FITTING WITH A RESILIENT CONTACT PIECE LOCKED AT A SPECIFIED POSITION THEREIN

BACKGROUND OF THE INVENTION

1. Field of the Invention

The present invention relates to a female terminal fitting and to a method of forming or producing it.

2. Description of the Related Art

A female terminal fitting is disclosed in International Publication No. WO 98/29924 and also is identified by the numeral 100 in FIG. 11 herein. The female terminal fitting 100 has a front end and a tube-shaped connecting portion 101 is provided at the front end of the female terminal fitting 100. A resilient contact piece 102 is provided inside the connecting portion 101 for resilient contact with an unillustrated mating male tab. The resilient contact piece 102 has a base at the upper side of the connecting portion 101 and extends back from the base. The resilient contact piece 101 then is curved arcuately down and again extends forward from a rear bottom of the connecting portion 101. However, the resilient contact piece 102 intercepts rays of light propagating in the inner space of the connecting portion 101 along forward and backward directions. As a result, infrared rays cannot measure the space between the resilient contact piece 102 and a contact portion 103 at the upper side. Hence, an improved female terminal fitting with a resilient contact piece has been developed. The improved terminal fitting has a resilient contact piece with a base at the rear side of the bottom surface of a connecting portion and a leading end that extends forward from the base.

Connectors and female terminal fittings have been miniaturized in recent years. Accordingly, the thickness of a metal plate before bending and a tolerance of precision errors in the bending process have been reduced to make the terminal fittings smaller. Small terminal fittings experience problems that terminal fittings of conventional size do not have. For example, the base of the resilient contact piece of the above-described female terminal fitting may be raised slightly by the resilience of the plate when folded at a specified position on the bottom surface. Although such a raised state may cause no problem for a female terminal fitting of conventional size, it may cause the smaller female terminal fitting to deviate from standard technical requirements.

The present invention was developed in view of the above problem and an object thereof is to provide a female terminal fitting in which a base portion of a resilient contact piece can be prevented from being raised even if the female terminal fitting is made smaller.

SUMMARY OF THE INVENTION

The invention relates to a female terminal fitting with a connecting portion connectable with a male tab of a mating male terminal fitting. Two contacts are provided on opposed walls of the connecting portion and are adapted to contact and tightly hold the male tab. One of the contacts is on a resilient contact piece configured for resilient contact with the male tab. A lock is substantially between a base of the resilient contact piece and the wall that has the contact to lock the base at a specified position. Accordingly, the resilient contact piece cannot be raised, and the female terminal fitting fulfills standard technical requirements even if the terminal fitting is small.

The connecting portion is substantially tubular, and hence can be inspected by light passing through the connecting portion.

The resilient contact piece preferably extends from the wall that faces the wall that has the other contact portion.

The connecting portion can be formed into the shape of a tube, for example, a rectangular tube or a cylindrical tube.

The base of the resilient contact piece may be provided at either the front side or the rear side in the connecting portion. Thus, the resilient contact piece may extend backward from the front side of the connecting portion or forward from the rear side of the connecting portion.

The locking construction may take any construction that positions the base of the resilient contact piece. Specifically, a cut may be made in a portion of the wall of the connecting portion, and the cut portion may be folded to bring the inner surface thereof into contact with the upper surface of the base. Alternatively a side edge of the base may partially serve as an engaging edge, and a locking hole may be formed in the wall for receiving the engaging edge.

Accordingly, the locking construction between the base and the wall positions the base of the resilient contact piece and prevents the base of the resilient contact piece from being raised. Thus, the female terminal fitting can fulfill standard technical requirements even if the terminal fitting is made small.

The locking construction preferably comprises an engaging edge that projects from a side edge of the base and a locking hole formed in the wall for receiving the engaging edge. Accordingly, the engaging edge that projects from the base fits into the locking hole in the wall during the bending of the female terminal fitting, thereby positioning the base of the resilient contact piece. Therefore, less labor is required as compared, for example, to a case where a cut is made in the wall and the cut portion is bent to bring the inner surface thereof into contact with the upper surface of the base.

The locking hole preferably is on a border of the wall adjacent to a lateral wall that is bent at an angle with respect to the wall portion.

Most preferably, the resilient contact piece projects in towards a mating side of the female terminal fitting with the male tab from its base.

The invention also relates to a method for forming a female terminal fitting. The method comprises providing a conductive plate, and stamping and bending the conductive plate to form a connecting portion with opposed facing walls. Two contacts are provided on the facing walls of the connecting portion. One of the contacts is provided on a resilient contact piece for resilient contact with the male tab. The walls are bent so that a lock is positioned substantially between a base of the resilient contact piece and the wall that has the contact locks the base at a specified position.

According to a preferred embodiment of the invention, the connecting portion is formed to be substantially tube-shaped.

Preferably, the resilient contact piece is formed to extend from the wall substantially facing the wall that has the other contact portion.

The locking construction preferably comprises an engaging edge that projects from a side edge of the base and a locking hole in the wall wherein the engaging edge is fitted into the locking hole when bending the walls. The locking hole preferably is formed on a border of the wall adjacent to a lateral wall that is bent at an angle with respect to the wall.

A cut preferably is made in a portion of the wall of the connecting portion for forming the lock. The cut is folded to bring the inner surface thereof into contact with the upper surface of the base, and a side edge of the base partially projects to serve as the engaging edge. The locking hole for receiving the engaging edge is provided in the wall.

The resilient contact piece preferably is formed to project in towards a mating side of the female terminal fitting with the male tab from its base.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
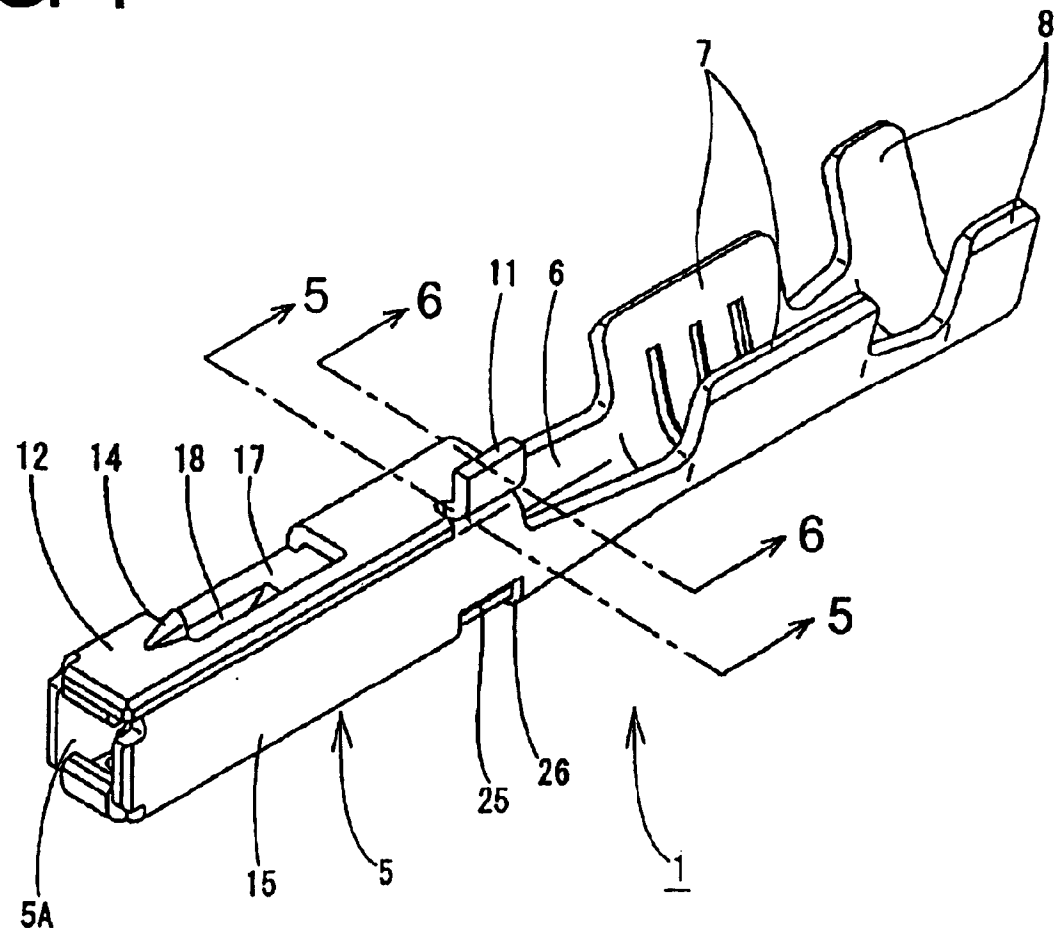
FIG. 1 is a perspective view of a female terminal fitting according to one embodiment of the present invention.

A female terminal fitting according to the invention is identified by the numeral 1 in FIG. 1. The female terminal fitting 1 is connectable with an end of a wire 2 and is mountable in a connector 3 (see FIG. 10). A male tab 4 of a mating male terminal fitting is connectable with the female terminal fitting 1. The female terminal fitting 1 is produced in consideration of miniaturization. For example, the front cross section of the terminal fitting 1 is about 0.6 mm to about 2 mm. In the following description, a end of the female terminal fitting 1 to be connected with the wire 2 is referred to as the rear side, and the side to be connected with the male tab 4 is referred to as a front side.

The front side of the female terminal fitting 1 defines a rectangular tubular connecting portion 5 with open front and rear ends. A coupling portion 6 with a substantially C-shaped cross section is behind the connecting portion 5.

Figure 2:
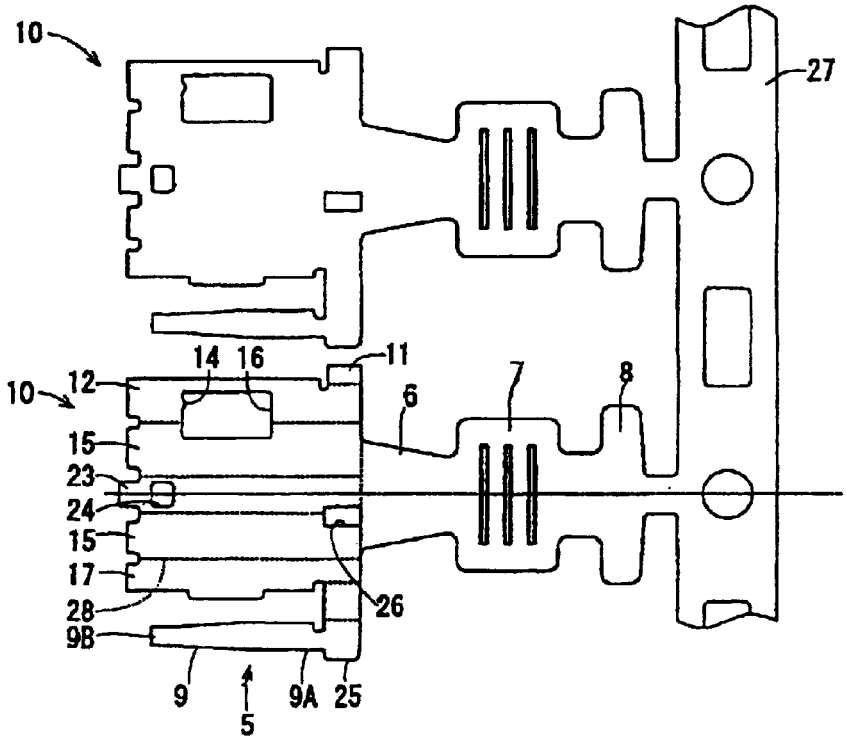
FIG. 2 is a development of the female terminal fitting.
Figure 3:
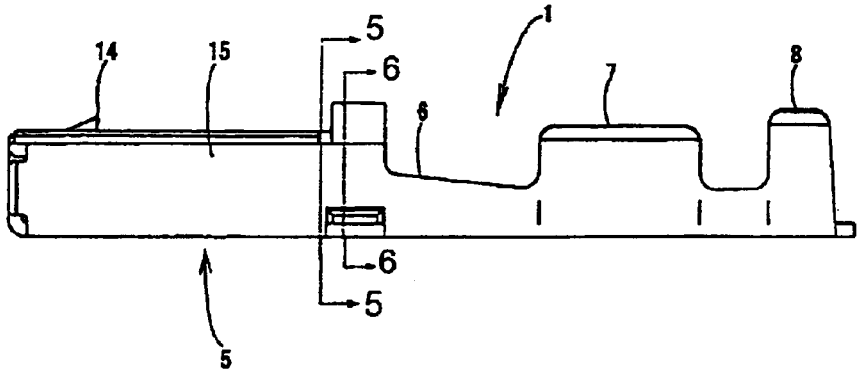
FIG. 3 is a side view of the female terminal fitting.
Figure 4:
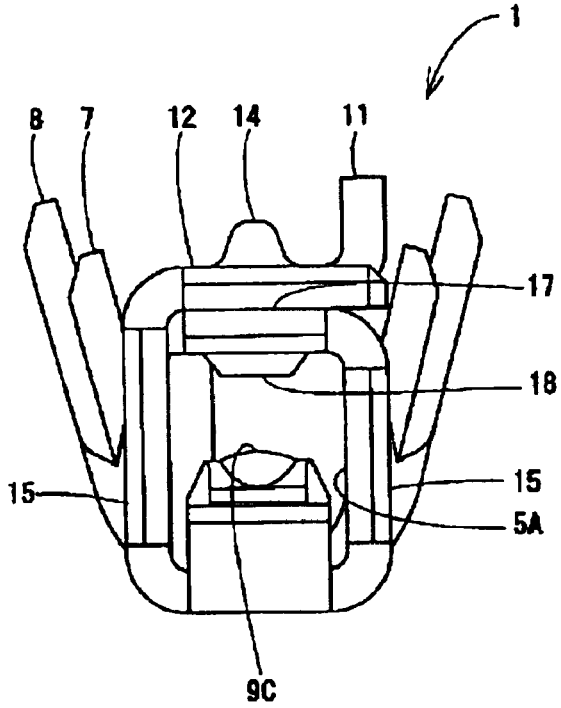
FIG. 4 is a front view of the female terminal fitting.
Figure 5:
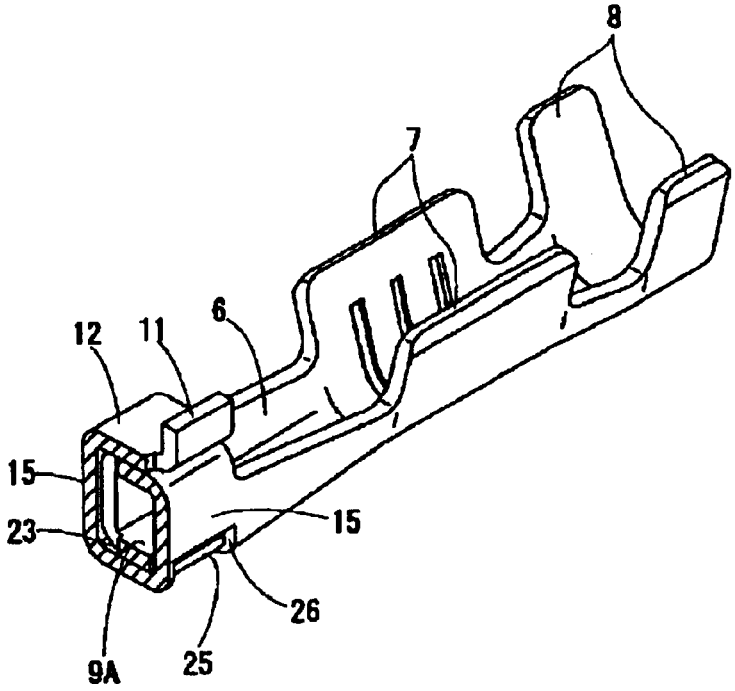
FIG. 5 is a perspective view of the female terminal fitting with a section along 5—5 of FIG. 1 or FIG. 3.
Figure 6:
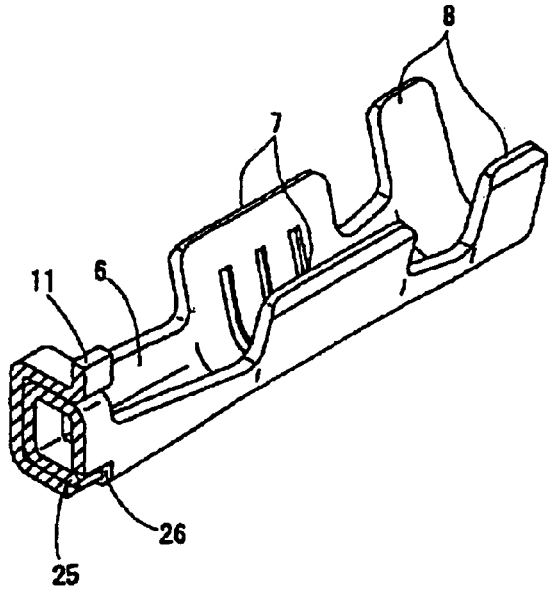
FIG. 6 is a perspective view of the female terminal fitting with a section along 6—6 of FIG. 1 or FIG. 3.
Figure 7:
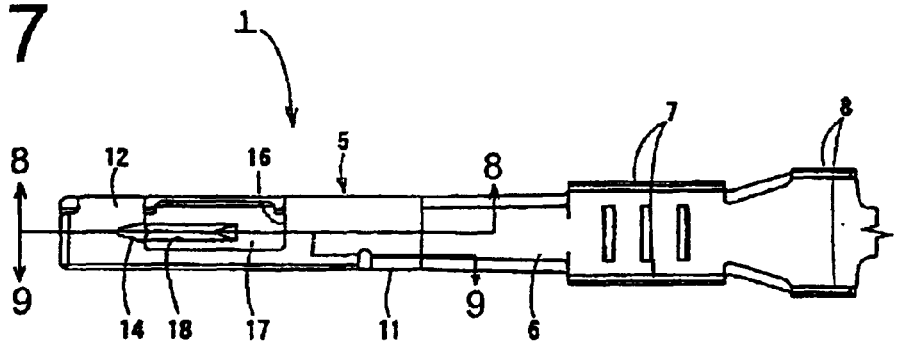
FIG. 7 is a plan view of the female terminal fitting.
Figure 8:
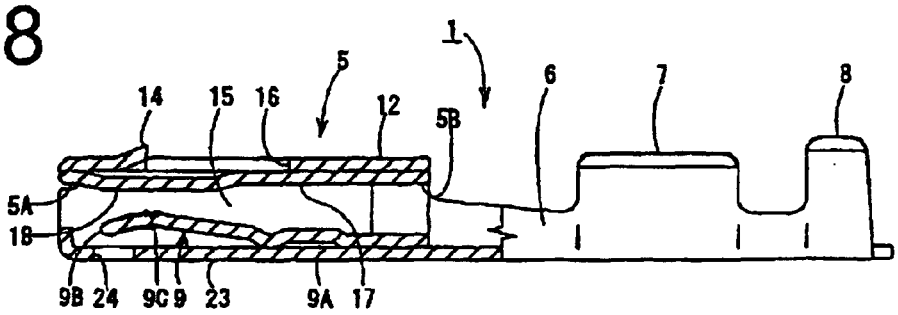
FIG. 8 is a side view partly in section along 8—8 of FIG. 7.
Figure 9:
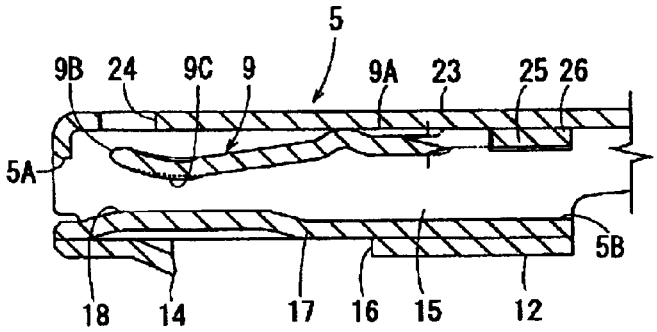
FIG. 9 is a vertical sectional view along 9—9 of FIG. 7.

The female terminal fittings 1 are formed from electrically conductive plates 10 that are disposed at specified intervals on a strip 27, as shown in FIG. 2. The plates 10 are formed into the female terminal fittings 1 by stamping, cutting, bending embossing and/or folding by a press.

The plate 10 is bent along specified bending lines 28 indicated by dotted line in the lower plate 10 in FIG. 2 in a specified procedure. However, the actual plate 10 looks like the plate 10 shown at the upper side of FIG. 2 without the bending lines 28. After formation, each female terminal filling 1 is separated from the strip 27, e.g. when being connected with the respective wire 2. Moreover, the female terminal fittings 1 may be supplied on or from a reel.

The resilient contact piece 9 of the plate 10 is formed substantially straight. An engaging edge 25 projects laterally from the base 9A of the resilient contact piece 9. The engaging edge 25 is fitted into a locking hole 26 while the female terminal fitting 1 is bent. The side hole 26 extends continuously from the sidewall 15 at one side into the bottom wall 23.

A stabilizer 11 projects at an upper rear corner of the connecting portion 5. The stabilizer 11 fits into a groove (not shown) in the upper wall of a terminal accommodating chamber 21 to restrict movement of the female terminal fitting 1 along vertical or lateral directions and to stabilize the position of the female terminal fitting 1 in the terminal accommodating chamber 21.

A window 16 is cut or stamped substantially in the middle of the upper wall 12, and an engaging portion 14 projects at the front edge of the window 16 to engage a resin lock 13 in a connector 3. Barrels 7, 8 are provided behind the coupling portion. More particularly, the wire barrels 7 are to be crimped, bent or folded into connection with a core inside the wire 2, while the insulation barrels 8 are to be crimped, bent or folded into connection with an insulation coating of the wire 2.

A male tab insertion opening 5A is provided at the front end of the connecting portion 5 for receiving the male tab 4 and a rear opening 58 is formed at the rear end of the connecting portion 5. The rectangular tubular connecting portion 5 has four walls, including opposed side walls 15, 15, an upper contact wall 17, an upper outer wall 12 outside the upper contact wall 17 and a bottom wall 23. The contact wall 17 is embossed, cut and bent to form a contact portion 18 for contact with the male tab 4, while tightly holding the male tab 4 in cooperation with the bottom wall 23. The bottom wall 23 has a resilient contact piece 9. The resilient contact piece 9 has a base 9A and a leading end 9B that extends obliquely up or in to the front from the base 9A. The resilient contact piece 9 can be brought resiliently into contact with the male tab 4. More specifically, the leading end 9B is curved slightly down and out, and a pointed second contact 9C is slightly behind the leading end 9B to contact and tightly hold the male tab 4.

A window 24 is formed in the bottom wall portion 23 below the leading end 9B of the resilient contact piece 9 for avoiding contact. As the resilient contact piece 9 is deformed down, the leading end 9B can escape into the window 24, to enlarge a degree of the resilient deformation of the resilient contact piece 9.

The plates 10 are bent along the specified bending lines 28 while being passed through a bending apparatus (not shown) to produce the female terminal fittings 1 with the rectangular tubular connecting portion 5. In this process, the engaging edge 25 is fit into the locking hole 26 to position the base 9A of the resilient contact piece 9.

The female terminal fittings 1 formed in this way are separated from the strip 27, and a wire 2 with an insulation coating stripped off at one end is placed into the rear side of each female terminal fitting 1 from above. The wire 2 and the female terminal fitting 1 then are connected with each other by crimping, bending or folding the barrels 7, 8.

Figure 10:
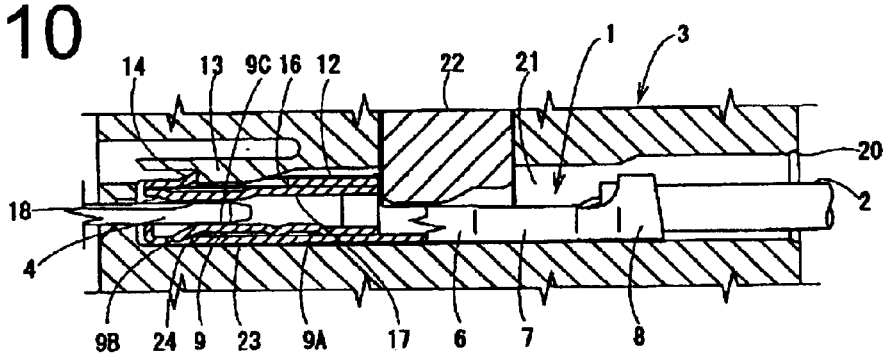
FIG. 10 is a side view partly in section showing a state where the female terminal fitting is mounted in a connector.
Figure 11:
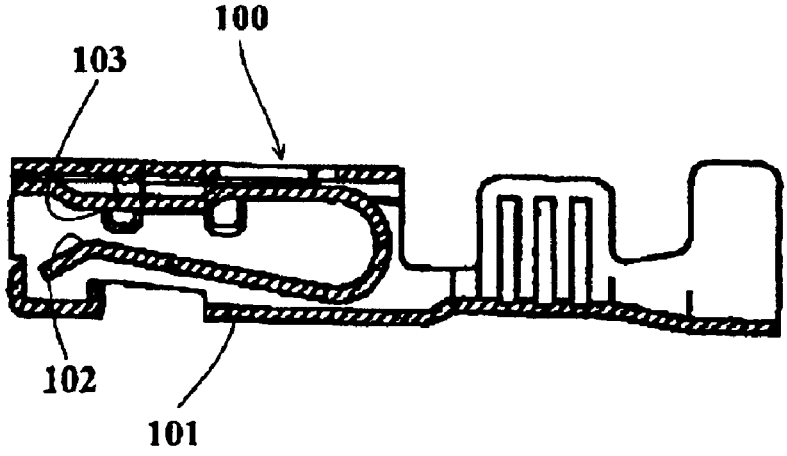
FIG. 11 PRIOR ART
FIG. 11 is a side view partly in section of a prior art female terminal fitting.

The leading end of the female terminal fitting 1 is inserted through a terminal insertion opening 20 of the connector 3 and into the terminal accommodating chamber 21. Sufficient pushing urges the female terminal fitting 1 to a proper mount position. Thus, the lock 13 engages the engaging portion 14 to prevent removal the female terminal fitting 1 from the terminal accommodating chamber 21. Thereafter, a retainer 22 is fit into the coupling portion 6 of the female terminal fitting 1 for doubly locking the female terminal fitting 1. The male tab 4 then can be inserted into the female terminal fitting 1. Consequently, the male tab 4 contacts the contact portions 9C, 18 and is held tightly, as shown in FIG. 10.

The engaging edge 25 engages the locking hole 26 between the base 9A and the sidewall 15 to position the base 9A of the resilient contact piece 9. Thus, the base 9A of the resilient contact piece 9 will not be raised. Thus, even if the female terminal fitting 1 is made smaller, standard technical requirements can be fulfilled.

The engaging edge 25 that projects from the base 9A is fit into the locking hole 26 in the side wall 15 when the female terminal fitting 1 is bent, and positions the base 9A of the resilient contact piece 9 in a longitudinal direction. Therefore, less labor is required as compared to, for example, a lock formed cutting a portion of the sidewall 15 and bending the cut portion to bring the inner surface thereof into contact with the upper surface of the base 9A.

The connecting portion 5 is a tube with open front and rear ends. Thus, rays of light can be passed through the inner space of the connecting portion 5 to test the space between the contact portions 18, 9C.

What is claimed is:

1. A female terminal fitting, comprising:

a tube-shaped connecting portion connectable with a male tab of a mating male terminal fitting, the tube-shaped connecting portion having first and second walls disposed in opposed facing relationship, and first and second contacts provided on the first and second walls of the connecting portion for contacting and tightly holding the male tab, wherein:

the first contact is on a resilient contact piece for resiliently contacting the male tab, the resilient contact piece having a base supported on the first wall and an engaging edge extending from the resilient contact piece and engaged in a locking hole in the connecting portion to lock the base at a specified position.

2. The female terminal fitting of claim 1, wherein the engaging edge projects from a side edge of the base and the locking hole is formed at least partly in the first wall for receiving the engaging edge.

3. The female terminal fitting of claim 2, wherein the locking hole is formed on a border portion of the first wall adjacent to a lateral wall that is bent substantially normal to the first wall.

4. The female terminal fitting of claim 3, wherein the resilient contact piece projects in towards a mating side of the female terminal fitting with the male tab from its base.

5. A female terminal fitting, comprising:

a substantially rectangular tubular connecting portion having opposite first and second ends with opposed substantially parallel first and second walls and opposed substantially parallel third and fourth walls, a locking hole formed transversely in the connecting portion in proximity to the first end at portions of the substantially rectangular tubular connecting portion defining a border between the first wall and the fourth wall; and a resilient contact piece in the tubular connecting portion, the resilient contact piece having a base in proximity to the first end of the connecting portion and a leading end in proximity to the second end of the connecting portion, an engaging edge extending transversely from the base and engaged in the locking hole for locking the base at a specified position in the connecting portion such that at least a portion of the base is in substantially face-to-face contact with the first wall.

6. The female terminal fitting of claim 5, wherein a side of the base opposite the engaging edge is unitary with the third wall, at least a portion of the base being in substantially face-to-face contact with the first wall.

* * * * *